US008701933B2

(12) United States Patent
Thomason

(10) Patent No.: US 8,701,933 B2
(45) Date of Patent: Apr. 22, 2014

(54) METHOD OF USING A BAG-IN-BOX CONTAINER SYSTEM

(75) Inventor: Scott R. Thomason, Macedonia, OH (US)

(73) Assignee: Sunless, Inc., Macedonia, OH (US)

( * ) Notice: Subject to any disclaimer, the term of this patent is extended or adjusted under 35 U.S.C. 154(b) by 0 days.

(21) Appl. No.: 13/602,532

(22) Filed: Sep. 4, 2012

(65) Prior Publication Data

US 2012/0324700 A1 Dec. 27, 2012

Related U.S. Application Data

(62) Division of application No. 12/412,880, filed on Mar. 27, 2009, now abandoned.

(60) Provisional application No. 61/191,887, filed on Sep. 13, 2008.

(51) Int. Cl.
*B65D 25/02* (2006.01)
*B65D 77/06* (2006.01)
*A47K 5/13* (2006.01)

(52) U.S. Cl.
CPC ..... *B65D 77/067* (2013.01); *A47K 5/13* (2013.01)
USPC ..... 222/1; 222/94; 222/105; 222/129; 222/135; 239/1; 239/304; 604/290; 141/2; 141/114; 141/319

(58) Field of Classification Search
CPC .. B65D 77/067; B65D 77/065; B65D 77/062; A47K 5/13
USPC ..... 222/1, 94, 105, 106, 129, 129.1, 130, 222/131, 173, 180, 181.1, 183, 185.1, 135; 141/1, 2, 104, 114, 319, 320; 239/1, 239/302–305; 604/289, 290
See application file for complete search history.

(56) References Cited

U.S. PATENT DOCUMENTS 2,954,901 A 10/1960 Winstead
3,054,549 A 9/1962 Frank (Continued)

FOREIGN PATENT DOCUMENTS

DE 3802793 8/1989
EP 06007339 4/2007

(Continued)

OTHER PUBLICATIONS

Written Opinion of the Authorized Searching Authority (Corresponding Application: PCT/US09/56541): Korean Intellectual Property Office; Authorized Officer Chang Soo Han; Issued Apr. 19, 2010.

(Continued)

*Primary Examiner* — J. Casimer Jacyna
(74) *Attorney, Agent, or Firm* — Benesch, Friedlander, Coplan & Aronoff LLP

(57) ABSTRACT

A method of employing a bag-in-box container system in a dispensing machine includes placing a box in a first orientation, inserting a bag in the box, and closing the box with a portion of a dispensing end of the bag protruding through an opening in a first wall of the box. The first wall is a top surface of the box in the first orientation. The method further includes securing the portion of the dispensing end outside of the box and inverting the box to a second orientation, such that the first wall is a bottom surface of the box in the second orientation. The method also includes inserting the dispensing end of the bag into a holder of a dispensing machine.

20 Claims, 11 Drawing Sheets

(56) References Cited

U.S. PATENT DOCUMENTS

| | | | | |
|---|---|---|---|---|
| 3,160,326 | A | 12/1964 | Sturdevant et al. | |
| 3,233,817 | A | 2/1966 | Casady | |
| 3,696,969 | A | 10/1972 | De Van et al. | |
| 4,572,422 | A | 2/1986 | Heuberger et al. | |
| 4,836,418 | A | 6/1989 | Dinslage | |
| 4,901,886 | A * | 2/1990 | Kirschner | 222/1 |
| 4,934,654 | A | 6/1990 | Linnemann | |
| 5,048,691 | A | 9/1991 | Heuberger et al. | |
| 5,054,644 | A | 10/1991 | Greenslade | |
| 5,082,145 | A | 1/1992 | McDonald | |
| 5,176,313 | A | 1/1993 | Curry et al. | |
| 5,201,462 | A | 4/1993 | Sada et al. | |
| 5,799,818 | A | 9/1998 | Ringer | |
| 5,816,449 | A | 10/1998 | Tanno et al. | |
| 6,123,226 | A * | 9/2000 | Giattino et al. | 222/2 |
| 6,290,124 | B2 | 9/2001 | Andrews et al. | |
| D456,710 | S | 5/2002 | Persson | |
| 6,637,623 | B2 | 10/2003 | Muise et al. | |
| 6,953,070 | B1 | 10/2005 | Labinski et al. | |
| 7,032,840 | B2 * | 4/2006 | Freidell | 239/307 |
| D575,637 | S | 8/2008 | Adams | |
| 7,571,835 | B2 | 8/2009 | Hill et al. | |
| 7,681,783 | B2 | 3/2010 | Stephenson | |
| 7,690,555 | B2 | 4/2010 | Churvis et al. | |
| 7,699,191 | B2 * | 4/2010 | Sheets et al. | 222/94 |
| D617,635 | S | 6/2010 | Gould | |
| D625,600 | S | 10/2010 | Hill | |
| 8,167,170 | B2 * | 5/2012 | Choiniere et al. | 222/94 |
| 8,186,569 | B2 | 5/2012 | Kelly | |
| 2001/0004994 | A1 | 6/2001 | Andrews et al. | |
| 2002/0047040 | A1 | 4/2002 | Andrews et al. | |
| 2004/0251272 | A1 * | 12/2004 | Hunter | 222/95 |
| 2004/0256485 | A1 * | 12/2004 | Joseph et al. | 239/302 |
| 2005/0077370 | A1 * | 4/2005 | Decker et al. | 239/1 |
| 2005/0211754 | A1 | 9/2005 | Fulcher | |
| 2005/0279865 | A1 * | 12/2005 | Thomason et al. | 239/526 |
| 2006/0180643 | A1 | 8/2006 | Stephenson | |
| 2006/0202005 | A1 | 9/2006 | Andrews et al. | |
| 2008/0006717 | A1 * | 1/2008 | Junkel et al. | 239/333 |
| 2008/0041882 | A1 | 2/2008 | Lips | |
| 2008/0135577 | A1 | 6/2008 | Erb | |
| 2009/0084834 | A1 | 4/2009 | Duyst | |
| 2009/0114311 | A1 | 5/2009 | McDowell | |
| 2009/0227966 | A2 * | 9/2009 | Malak | 604/290 |
| 2011/0253774 | A1 | 10/2011 | Hill et al. | |

FOREIGN PATENT DOCUMENTS

| | | |
|---|---|---|
| GB | 1161713 | 8/1969 |
| JP | 2002225941 | 8/2002 |
| JP | 2002255240 | 9/2002 |
| WO | 2007112752 | 10/2007 |
| WO | 2007133952 | 11/2007 |

OTHER PUBLICATIONS

International Search Report from Corresponding Application: PCT/US09/56541; Korean Intellectual Property Office; Authorized Officer Chang Soo Han; Issued Apr. 22, 2010.

International Search Report from Corresponding Application: PCT/US2007/068117; European Patent Office; Authorized Officer Appelt, Lothar, Issued Sep. 18, 2007.

International Search Report from Corresponding Application: PCT/DK2007/000167; European Patent Office; Authorized Officer Mueller, Claus; Issued Aug. 21, 2007.

Office Action from Corresponding U.S. Appl. No. 12/412,880; U. S. Patent and Trademark Office; Dated Oct. 24, 2011.

Office Action from Corresponding U.S. Appl. No. 12/412,880; U. S. Patent and Trademark Office; Dated Dec. 19, 2011.

Office Action from Corresponding U.S. Appl. No. 12/412,880; U. S. Patent and Trademark Office; Dated May 1, 2012.

Office Action from Corresponding U.S. Appl. No. 12/412,880; U. S. Patent and Trademark Office; Dated Sep. 23, 2011.

Notice of Allowance and Fee(s) Due from Corresponding U.S. Appl. No. 29/401,783; U.S. Patent and Trademark Office; Dated Oct. 9, 2012.

Issue Notification from Corresponding U.S. Appl. No. 29/401,783; U.S. Patent and Trademark Office; Dated Nov. 27, 2012.

* cited by examiner

METHOD OF USING A BAG-IN-BOX CONTAINER SYSTEM

CROSS-REFERENCES TO RELATED APPLICATIONS

This application is a divisional of U.S. patent application Ser. No. 12/412,880 filed Mar. 27, 2009, which claims priority to U.S. Provisional Application No. 61/191,887 filed Sep. 13, 2008. The disclosures of both applications is hereby incorporated by reference in their entirety.

FIELD OF THE INVENTION

The present application relates to container systems and, more particularly, to bag-in-box container systems for interaction with spraying or dispensing systems.

BACKGROUND

Humans apply many products to their bodies for cosmetic purposes. These products include moisturizers, sunscreens, anti-aging treatments, UV tanning accelerators, sunless tanning products, and so on. Numerous forms of artificial tanning products are currently available, including lotions, creams, gels, oils, and sprays. These products are typically mixtures of a chemically-active skin colorant or a bronzer, in combination with moisturizers, preservatives, antimicrobials, thickeners, solvents, emulsifiers, fragrances, surfactants, stabilizers, sunscreens, pH adjusters, anti-caking agents, and additional ingredients to alter the color reaction.

Systems exist for applying artificial tanning products including spraying booths for fluid containment used in conjunction with handheld sprayers, and closed booths equipped with automated spraying systems. These spraying systems may use high pressure compressed air nozzles along with sunless tanning composition fluids supplied to the nozzle to create atomized sprays directed towards the body. Sunless tanning composition fluids, as well as fluids in countless other applications, must be packaged in containers suitable for transportation of the fluids, for interaction with spraying or dispensing systems, and for economically efficient disposal.

Conventionally, fluids have been packaged in rigid containers that provide satisfactory interaction with spraying or dispensing systems. However, these rigid containers are inefficient in terms of storage and disposal of empty containers because they retain their volume even after the fluids have been exhausted. Flexible containers such as bag-in-box containers provide more economically efficient containers in terms of storage and disposal. However, conventionally, these flexible containers have been used in applications that rely on pressurized air for evacuation of fluid from the bag while the bag-in-box system is sitting upright. Conventional, bag-in-box systems do not provide a sufficiently rigid container for proper interaction with spraying and dispensing systems that require upside-down installation for gravity to assist, at least in part, in the evacuation of the contents in the bag. Some of these upside-down applications may require also require a blind connection to be made between the bag-in-box system and dispensing machinery.

SUMMARY

In one embodiment, a method of providing fluid to a dispensing machine includes providing a bag having a dispensing end, the bag having fluid disposed therein. The method further includes providing a box in a first orientation. The box has a first wall with an opening disposed therein. The method also includes providing a dispensing machine having a holder configured to receive the dispensing end of the bag. The method further includes inserting the bag in the box, and closing the box with a portion of the dispensing end of the bag protruding through the opening in the first wall, wherein the first wall is a top surface of the box in the first orientation. The method also includes securing the portion of the dispensing end outside of the box and inverting the box to a second orientation, such that the first wall is a bottom surface of the box in the second orientation. The method further includes inserting the dispensing end of the bag into the holder of the dispensing machine.

In another embodiment, a method of employing a bag-in-box container system in a dispensing machine includes providing a bag-in-box container system. The bag-in-box container includes a box having a first wall with an opening disposed therein. The first wall is a top surface when the box is in a first orientation and the first wall is a bottom surface when the box is in a second orientation. The bag-in-box container system further includes a bag disposed inside the box, the bag having a dispensing end that protrudes through the opening in the first wall of the box. The method further includes providing a dispensing machine having a holder configured to receive the dispensing end of the bag. The method also includes placing the bag-in-box container system in the second orientation, and inserting the dispensing end of the bag into the holder of the dispensing machine.

In yet another embodiment, a method of employing a bag-in-box container system in a dispensing machine includes placing a box in a first orientation, inserting a bag in the box, and closing the box with a portion of a dispensing end of the bag protruding through an opening in a first wall of the box. The first wall is a top surface of the box in the first orientation. The method further includes securing the portion of the dispensing end outside of the box and inverting the box to a second orientation, such that the first wall is a bottom surface of the box in the second orientation. The method also includes inserting the dispensing end of the bag into a holder of a dispensing machine.

BRIEF DESCRIPTION OF DRAWINGS

The accompanying drawings, together with the detailed description provided below, describe exemplary embodiments of the claimed invention. In the drawings and description that follow, like elements are identified with the same reference numerals. The drawings are not to scale and the proportion of certain elements may be exaggerated for the purpose of illustration.

DETAILED DESCRIPTION

The following includes definitions of selected terms. The definitions include various examples or forms of components that fall within the scope of a term. The examples are not intended to be limiting.

Figure 1:
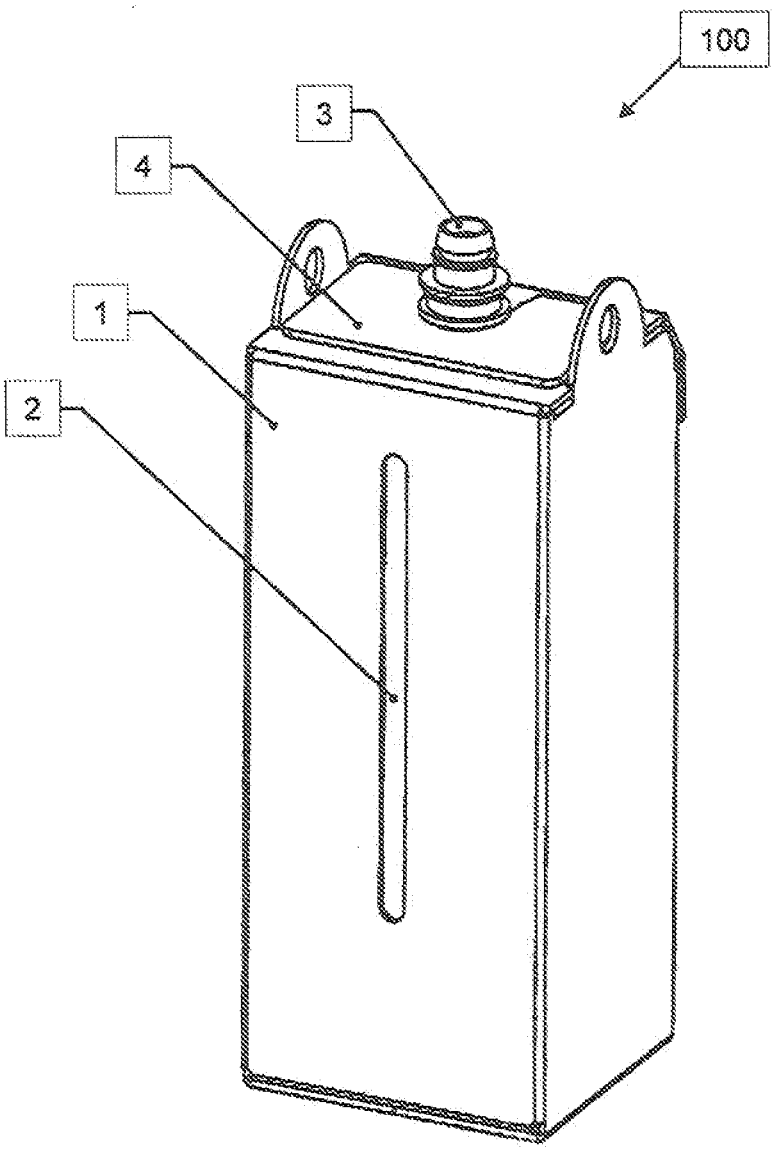
FIG. 1 illustrates a perspective front view of an embodiment of a bag-in-box container system.

FIG. 1 illustrates a perspective front view of an embodiment of a bag-in-box container system. The example container system 100 includes a box 1. Box 1 may be constructed of various different materials (cardboard, plastic, and so on) to give box 1 suitable rigidity, weight, etc. for the specific application. Example container system 100 also includes a bag 2. Bag 2 may contain liquids such as those used for sunless tanning, as well as other liquids for various other uses. Bag 2 may have a valved fitting or dispensing end 3 that may provide a fluidic path for the fluid in bag 2. Example box 1 has an opening on one of its walls for the dispensing end 3 to partially come through. Dispensing end 3 may have annular ringed flanges or ribs for, among other functions, connecting system 100 to equipment or machinery using the fluids inside of bag 2. Dispensing end 3 may also include a collar (not shown) of a larger perimeter than the opening in box 1 such that the collar contacts the inside of box 1 around the opening. The contact between the collar and the inside of box 1 resists bag 2 from being pulled out of the box through the opening. Dispensing end 3 may also include a flange, rib, or set of flanges or ribs forming a groove or slot for a clip 4, a spring clip (not shown), or some other means of engagement to engage dispensing end 3 and resist a force pushing in a direction towards the inside of box 1.

Figure 2:
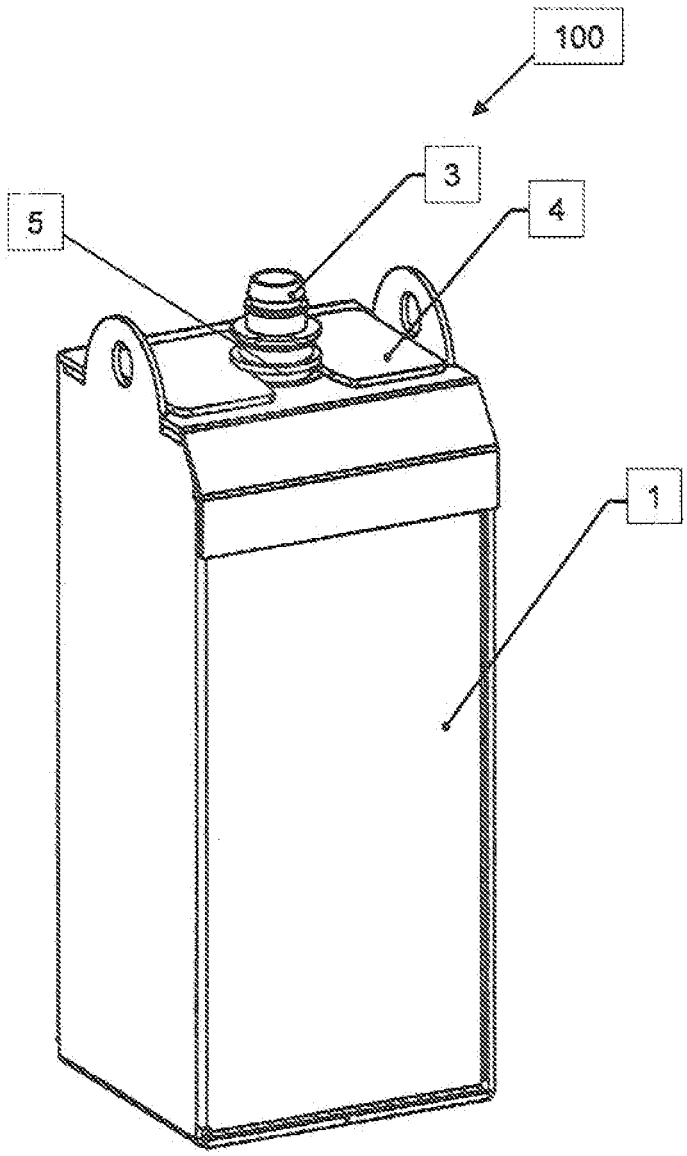
FIG. 2 illustrates a perspective rear view of an embodiment of a bag-in-box container system.

FIG. 2 illustrates a perspective rear view of an embodiment of a bag-in-box container system 100. In the example embodiment, dispensing end 3 includes a groove 5. The example embodiment also includes a clip 4 that engages groove 5 to hold dispensing end 3 in place relative to box 1. Engagement of groove 5 and clip 4 causes clip 4 to resist a force urging dispensing end 3 inside box 1 by, for example, force exerted on dispensing end 3 when connecting system 100 to dispensing or spraying machinery. During and after connection to the machinery, clip 4 distributes, at least partially, the force exerted on dispensing end 3 along the opening end outside wall of the box contributing to the rigidity of system 100.

Clip 4 may have an opening for sliding in place into groove 5 in dispensing end 3. Groove 5 may be formed by two spaced walls or flanges radially extending from dispensing end 3. Groove 5 may be located in dispensing end 3 so that the proximal most wall or flange of groove 5 is flush with the outside surface of the opening wall of box 1. In this example embodiment, groove 5 is disposed immediately outside of box 1 near the opening. Clip 4 may then engage dispensing end 3 at groove 5 with at least some surface area of clip 4 remaining in contact with the outside surface of the opening wall of box 1, providing for very little, if any, play of dispensing end 3 in and out of box 1.

Engaging a portion of dispensing end 3 outside box 1 may be accomplished by various other means. In an example prophetic embodiment, engagement of a groove 5 is accomplished by a flap integral to box 1 that slides into groove 5 and prevents dispensing end 3 from pushing into box 1 through the opening. In another prophetic embodiment, dispensing end 3 may be engaged by inserting a grooved insert into a flange in dispensing end 3. Dispensing end 3 may be alternatively or additionally engaged by a spring clip (not shown) that engages groove 5. Various other methods of engagement may be used.

Figure 3:
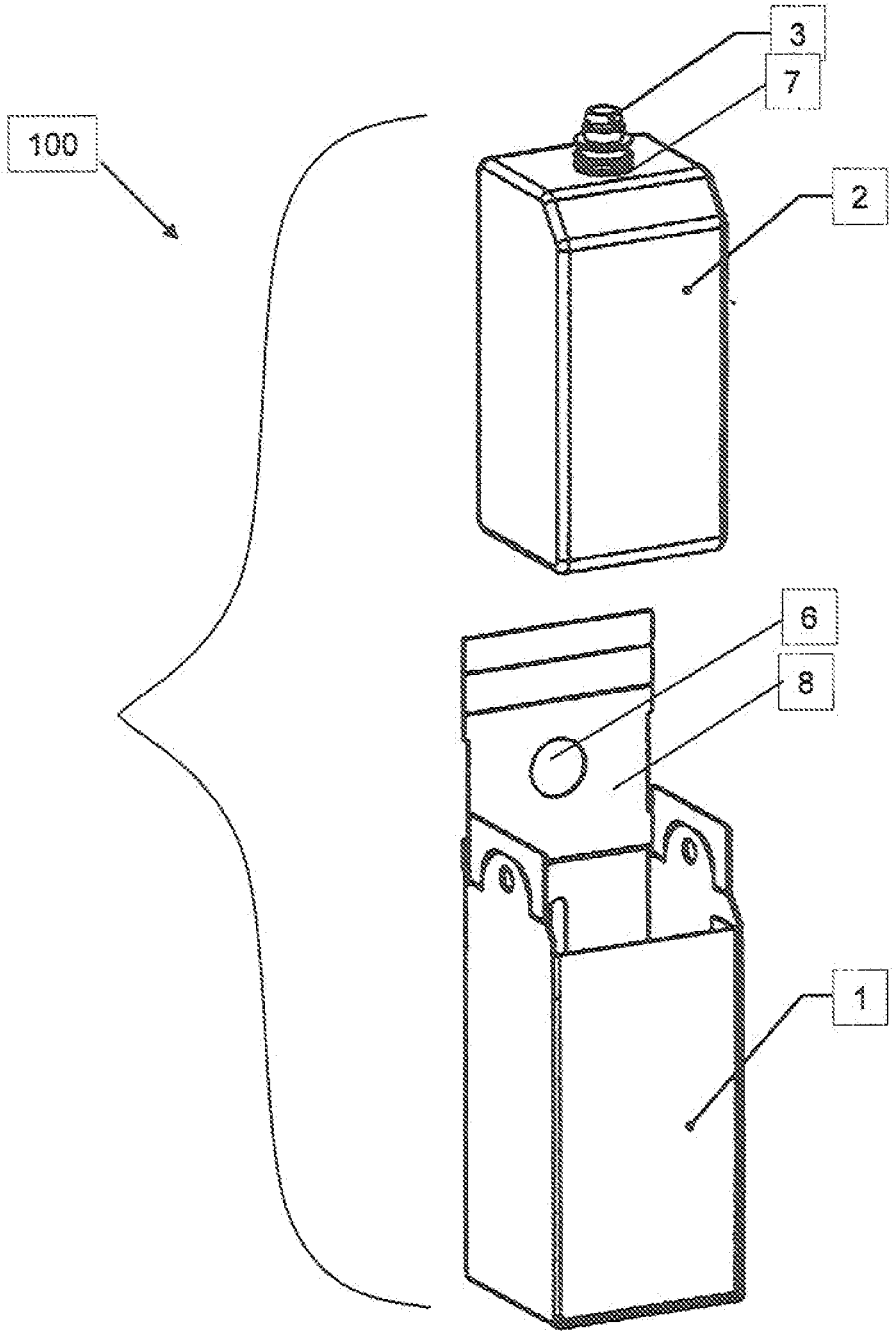
FIG. 3 illustrates a perspective front exploded view of an embodiment of a bag-in-box container system.

FIG. 3 illustrates a perspective front exploded view of an embodiment of a bag-in-box container system. In the example embodiment, bag-in-box container system 100 includes box 1 and bag 2. To assemble bag-in-box system 100, bag 2 is inserted inside box 1, and box 1 is closed with a portion of dispensing end 3 protruding through opening 6. Dispensing end 3 may also include a collar 7 of a larger perimeter than opening 6 such that collar 7 contacts the inside surface of top wall 8 around opening 6. The contact between collar 7 and the inside surface of top wall 8 resists bag 2 from being pulled out of the box through opening 6. Bag 2 may be manufactured of a flexible material. Box 1 may be designed and manufactured such that when fully assembled, bag-in-box system 100 with clip 4 engaged in groove 5 mimics a single, stable, rigid container.

In example system 100, opening 6 and collar 7 are shown to have circular geometries. In the example embodiment, the perimeters of opening 6 and collar 7 would be their respective circumferences. However, opening 6 and collar 7 may be of various non-circular geometries (square, oval, rectangular, and so on). In an alternate embodiment, collar 7 would be reinforced or supported by an additional clip (not shown) disposed inside box 1 and held in position with or without an additional groove on dispensing end 3.

Figure 4:
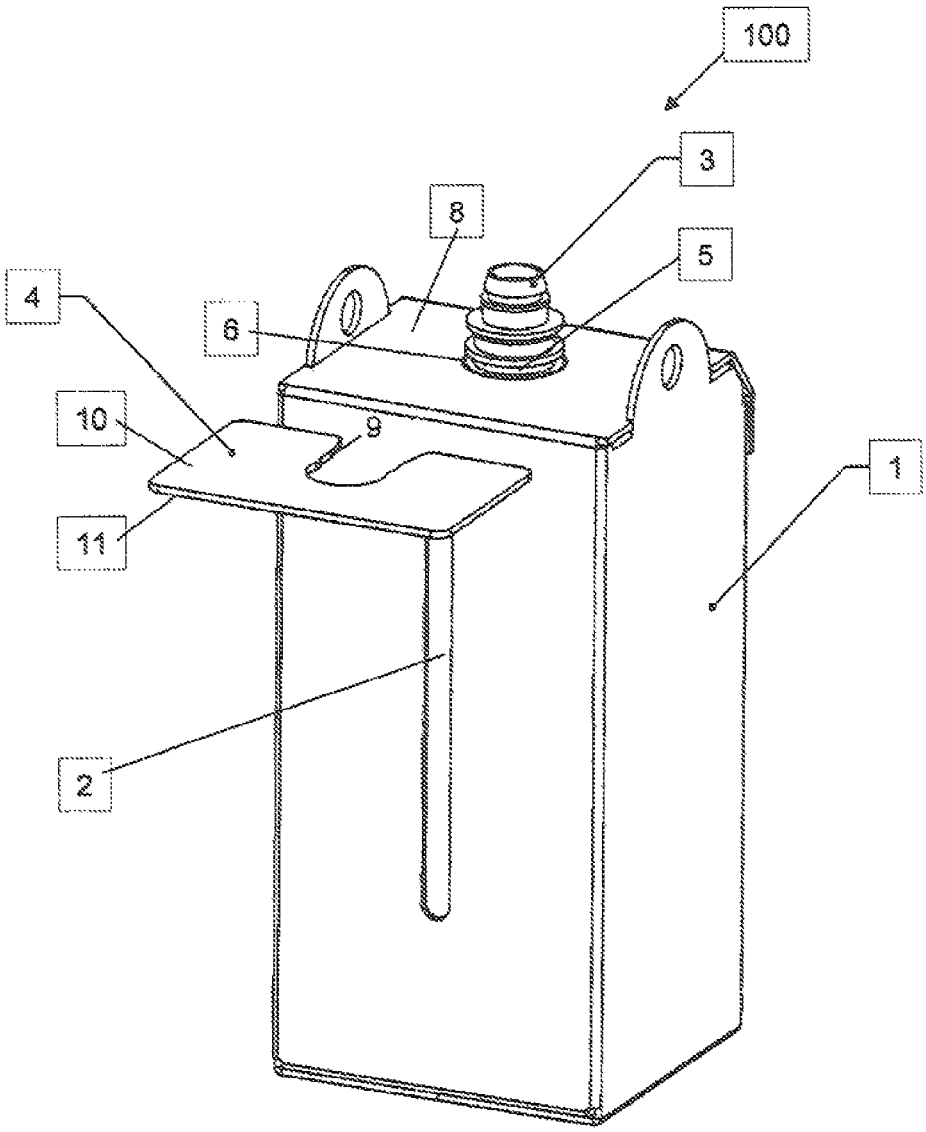
FIG. 4 illustrates a perspective front exploded view of an embodiment of a bag-in-box container system with a clip.

FIG. 4 illustrates a perspective front exploded view of an embodiment of a bag-in-box liquid container system 100 with a clip 4. In the example embodiment, after bag 2 has been inserted inside box 1 with dispensing end 3 protruding through opening 6, clip 4 may be inserted or slid into groove 5. Clip 4 has a shape complimentary to groove 5 such that clip 4 tightly fits on to groove 5 when pressed into engagement position. In this embodiment, clip 4 has a U-shaped opening. The U-shaped opening defines an engaging surface 9 for clip 4 to engage groove 5 of dispensing end 3 protruding through opening 6 in a wall of box 1. In a prophetic embodiment, engaging surface 9 may be part of a flap, integral to or separable from box 1, that slides into groove 5 to secure dispensing end 3 in place. In another prophetic embodiment, the engaging surface may be part of a spring clip or similar structure that engages groove 5 or some other portion of dispensing end 3 to secure dispensing end 3 in place. In other embodiments, engaging surface 9 could be formed by a discontinuous engaging surface or multiple engaging surfaces.

In one embodiment, clip 4 has top and bottom surfaces 10 and 11, respectively. In the example embodiment, when clip 4 is fully inserted into groove 5, top surface 10 contacts the distal wall of groove 5 preventing dispensing end 3 from recessing into box 1 through opening 6. The bottom surface 11, in turn, distributes at least some of the force applied to dispensing end 3 across the top wall 8 of box 1. This distribution of force along the larger area of top wall 8 makes bag-in-box system 100 relatively rigid. The rigidity of system 100 makes it suitable for connecting to dispensing equipment even when system 100 is inverted upside-down and connected to dispensing equipment in a blind connection where substantial force may be exerted on system 100 to permit dispensing end 3 to connect to a mating fitting fixed to dispensing machinery. System 100 may be sufficiently rigid to be self supporting in such an application when mounted by means of dispensing end 3 in an inverted angled or upside-down orientation.

In one embodiment, engaging surface 9 may have dimples for a snap engagement between clip 4 and groove 5. In another embodiment, engaging surface 9 may have a total engaging circumference in excess of half the outside circumference of groove 5 for a snap engagement. Clip 4, among other embodiments, could also be a spring clip (not shown) that may be compressed, placed over groove 5, and released to engage groove 5. Clip 4 may be fabricated of various known materials (e.g. plastic, metal, and so on).

After the contents of bag 2 have been exhausted, the bag-in-box system 100 may be removed from the dispensing machinery, clip 4 may be removed from groove 5, box 1 opened, bag 2 removed from box 1, and both box 1 and bag 2 may be collapsed to a relatively small volume to be discarded or recycled.

Figure 5:
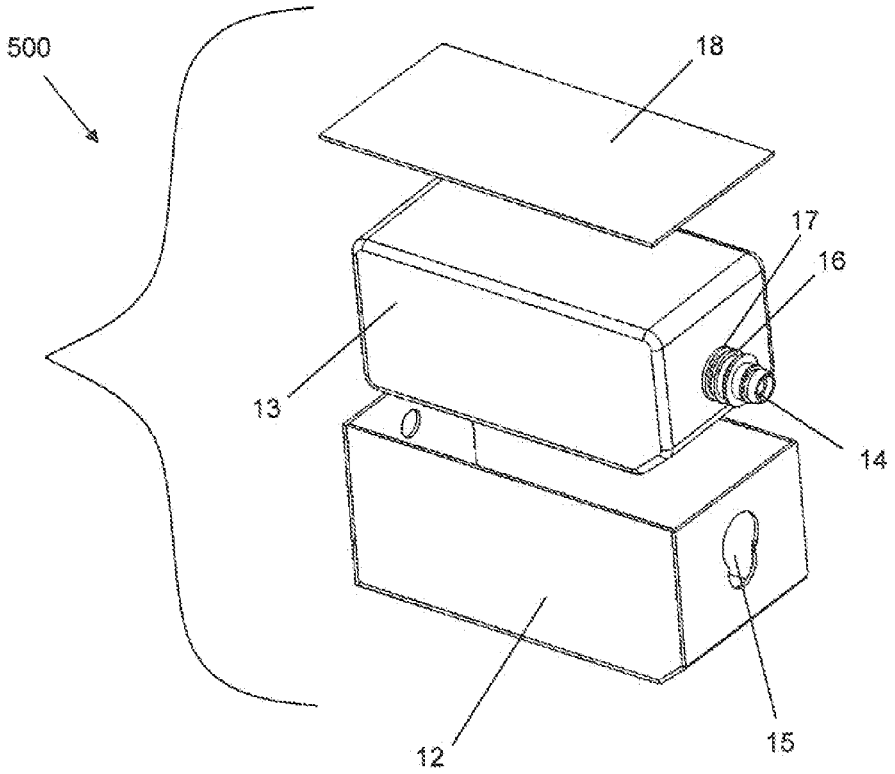
FIG. 5 illustrates an exploded view of an embodiment of a bag-in-box container system.
Figure 6:
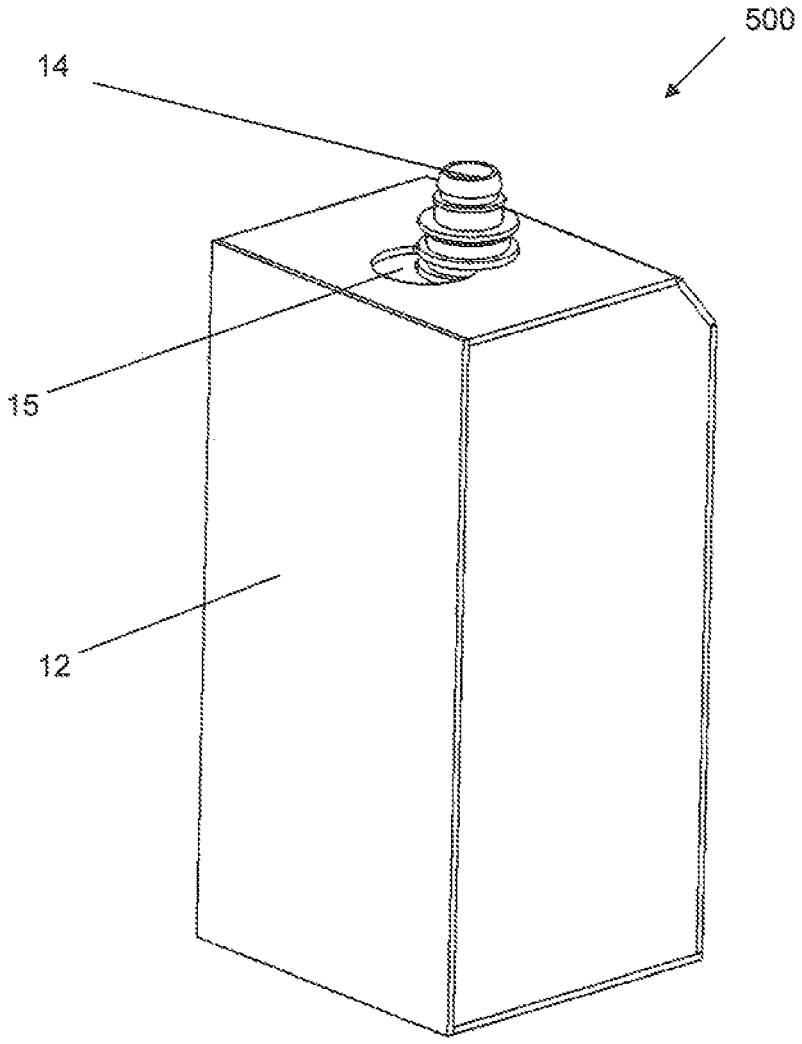
FIG. 6 illustrates a perspective view of an embodiment of a bag-in-box container system

FIG. 5 illustrates an exploded view and FIG. 6 illustrates a perspective view of an embodiment of a bag-in-box container system 500. The example container system 500 includes a box 12. Box 12 may be constructed of various different materials (cardboard, plastic, and so on) to give box 12 suitable rigidity, weight, etc. for the specific application. Example container system 500 also includes a bag 13, which may contain liquids such as those used for sunless tanning, as well as other liquids for various other uses. Bag 13 may have a valved fitting or dispensing end 14 that may provide a fluidic path for fluid in bag 13. Dispensing end 14 may also have annular ringed flanges or ribs for, among other functions, connecting system 500 to equipment or machinery for dispensing the fluids inside of the bag.

Example box 12 has an opening 15 on one of its walls. Dispensing end 14 may include a flange, rib, or set of flanges or ribs forming a groove or slot 16 and opening 15 may incorporate two different diameters for dispensing end 14 to partially come through the larger diameter and engage into the smaller diameter at groove or slot 16 to resist a force pushing in a direction towards the inside of box 12. Dispensing end 14 may also include a collar 17 of a larger perimeter than the smaller diameter in opening 15 such that the collar contacts the inside of box 13 around the smaller diameter resisting bag 13 from being pulled out of box 12 through opening 15. Engagement at groove or slot 16 resists a force urging dispensing end 14 inside box 12 by, for example, force exerted on dispensing end 14 when connecting system 500 to dispensing or spraying machinery. During and after connection to the machinery, this force exerted on dispensing end 14 is distributed along the wall surface of box 12 around opening 15 contributing to the rigidity of system 500.

In one embodiment, system 500 may include a lid 18 for closing the bag-in-box container. After the contents of bag 13 have been exhausted, the bag-in-box system 500 may be removed from the dispensing machinery, lid 18 removed, bag 13 removed from box 12, and bag 13 may be collapsed to a relatively small volume to be discarded or recycled. Box 12 may be "refilled" with a full bag 13, reassembled and reinstalled on the dispensing machinery.

Figure 7A:
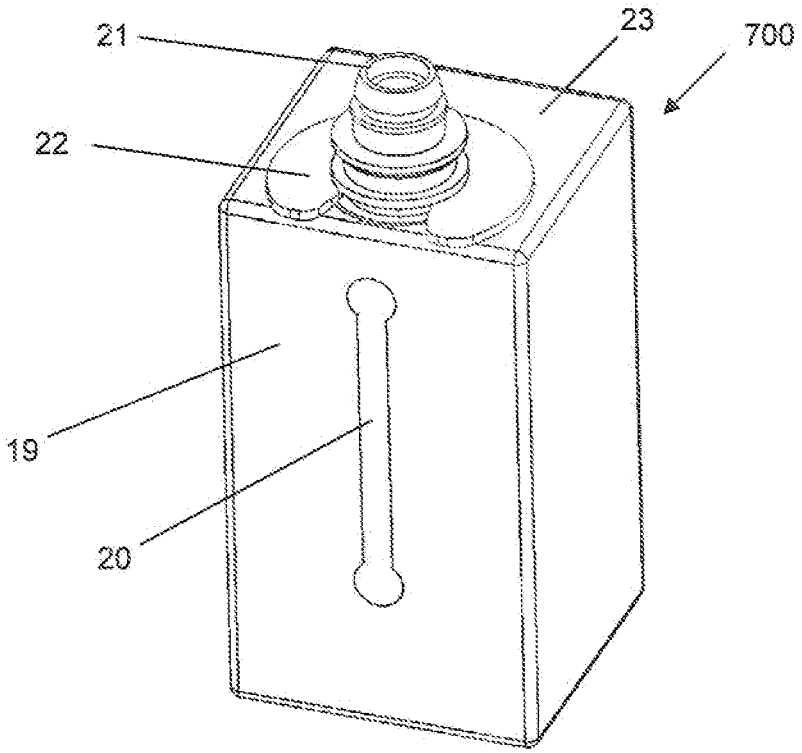
FIG. 7A illustrates a perspective front view of an embodiment of a bag-in-box container system.
Figure 7B:
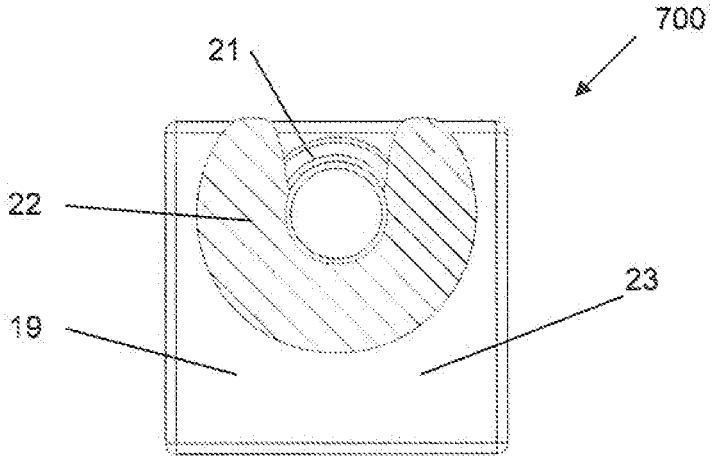
FIG. 7B illustrates a perspective top view of an embodiment of a bag-in-box container system.

FIGS. 7A and 7B illustrates a perspective front view and a top view, respectively, of an embodiment of a bag-in-box container system 700. The example container system 700 includes a box 19. Box 19 may be constructed of various different materials (cardboard, plastic, and so on) to give box 19 suitable rigidity, weight, etc. for the specific application. Example container system 700 also includes a bag 20. Bag 20 may contain liquids such as those used for sunless tanning, as well as other liquids for various other uses. Bag 20 may have a valved fitting or dispensing end 21 that may provide a fluidic path for the fluid in bag 20. Dispensing end 21 may have annular ringed flanges or ribs for, among other functions, connecting system 700 to equipment or machinery for dispensing the fluids inside of bag 20. Example box 19 has an opening on one of its walls, in this example top wall 23, for dispensing end 21 to partially come through the opening.

To assemble bag-in-box system 700, bag 20 is inserted inside box 19 with a portion of dispensing end 21 protruding through the opening on wall 23. Dispensing end 21 may also include a collar (not shown) of a larger perimeter than the opening in box 19 such that the collar contacts the inside of wall 23 around the opening. The contact between the collar and the inside of wall 23 resists bag 20 from being pulled out of box 19 through the opening. Dispensing end 21 may also include a flange, rib, or set of flanges or ribs forming a groove or slot for a clip 22, a spring clip (not shown), or some other means of engagement to engage dispensing end 21 and resist a force pushing in a direction towards the inside of box 19.

In the example embodiment, clip 22 engages dispensing end 21 at a groove in dispensing end 21 and holds bag 20 in place relative to box 19. Engagement of dispensing end 21 and clip 22 causes clip 22 to resist a force urging dispensing end 21 inside box 19 by, for example, force exerted on dispensing end 21 when connecting system 700 to dispensing or spraying machinery. During and after connection to the machinery, clip 22 distributes, at least partially, the force exerted on dispensing end 21 along the opening end outside wall of box 19, in this case top wall 23, contributing to the rigidity of system 700.

Clip 22 may have an opening for sliding in place into the groove in dispensing end 21. The groove may be formed by two spaced walls or flanges radially extending from dispensing end 21. The groove may be located in dispensing end 21 so that the proximal most wall or flange of the groove is flush with the outside surface of the opening wall of box 19. In this example embodiment, the groove is disposed immediately outside of box 19 near the opening on wall 23. Clip 22 may then engage dispensing end 21 at the groove with at least some surface area of clip 22 remaining in contact with the outside surface of wall 23, providing for very little, if any, play of dispensing end 21 in and out of box 19.

Bag 20 may be manufactured of a flexible material. Box 19 may be designed and manufactured such that when fully assembled, bag-in-box system 700 with clip 22 engaged mimics a single, stable, rigid container.

In the example embodiment, after bag 20 has been inserted inside box 19 with dispensing end 21 protruding through the opening on wall 23, clip 22 may be inserted or slid into the groove in dispensing end 21. Clip 22 has a shape complimentary to the groove such that clip 22 tightly fits on to the groove when pressed into engagement position. In the example embodiment, when clip 22 is fully inserted into the groove, it prevents dispensing end 21 from recessing into box 19 through the opening. A bottom surface of clip 22, in turn, distributes at least some of the force applied to dispensing end 21 in the direction to the inside of box 19 across the top wall 23. This distribution of force along the larger area of top wall 23 contributes in making bag-in-box system 700 relatively rigid. The rigidity of system 700 makes it suitable for connecting to dispensing equipment even when system 700 is inverted upside-down and connected to dispensing equipment in a blind connection where substantial force may be exerted on system 700 to permit dispensing end 21 to connect to a mating fitting fixed to dispensing machinery. System 700 may be sufficiently rigid to be self supporting in such an application when mounted by means of dispensing end 21 in an inverted angled or upside-down orientation.

Figure 8:
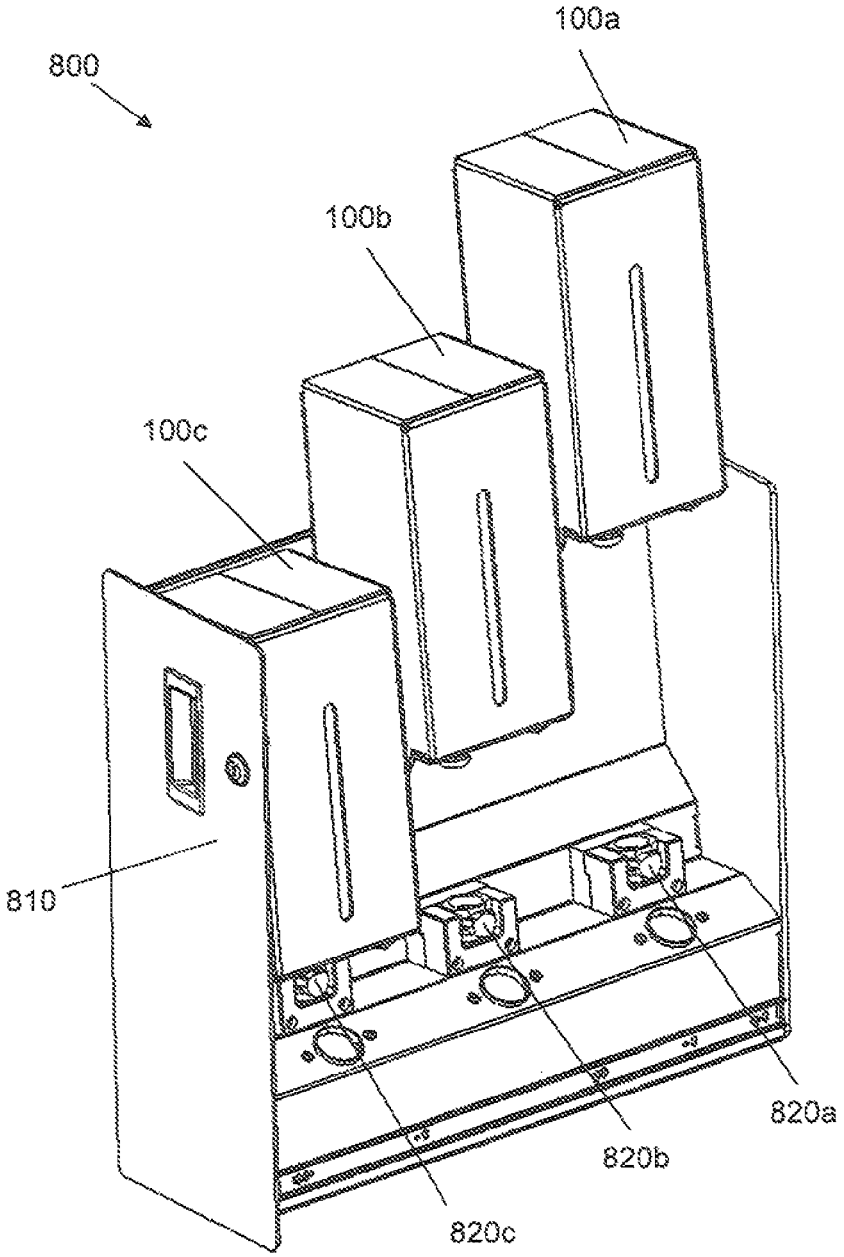
FIG. 8 illustrates a partially assembled example application for a bag-in-box container system.
Figure 9:
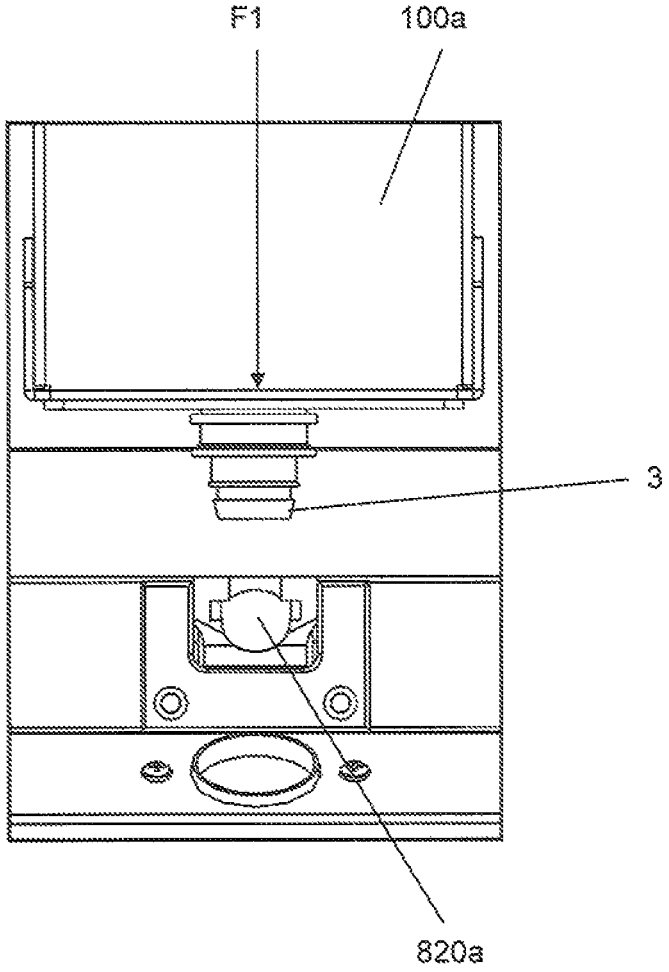
FIG. 9 illustrates an expanded or close up view of the partially assembled example application for bag-in-box container systems of FIG. 8.

FIG. 8 illustrates a partially assembled example application 800 for bag-in-box container systems interacting with portions of a dispensing machinery 810. FIG. 9 illustrates an expanded or close-up view of the partially assembled example application 800 of FIG. 8. In example application 800, multiple bag-in-box liquid systems 100*a*, 100*b*, and 100*c* may be inserted into fixed holders 820*a*, 820*b*, and 820*c* that may be part of dispensing machinery 810. Bag-in-box system 100*a*, for example, is inverted for connection to holder 820*a*. When system 100*a* is inverted a force F1 including the weight of the liquid inside system 100*a*, is exerted on the collar that forms part of the dispensing end against the inside surface of the opening end wall of the box. The weight tends to push the dispensing end in a direction outside of the box through the opening. The collar resists the dispensing end from being pushed out the box by force F1.

Figure 10:
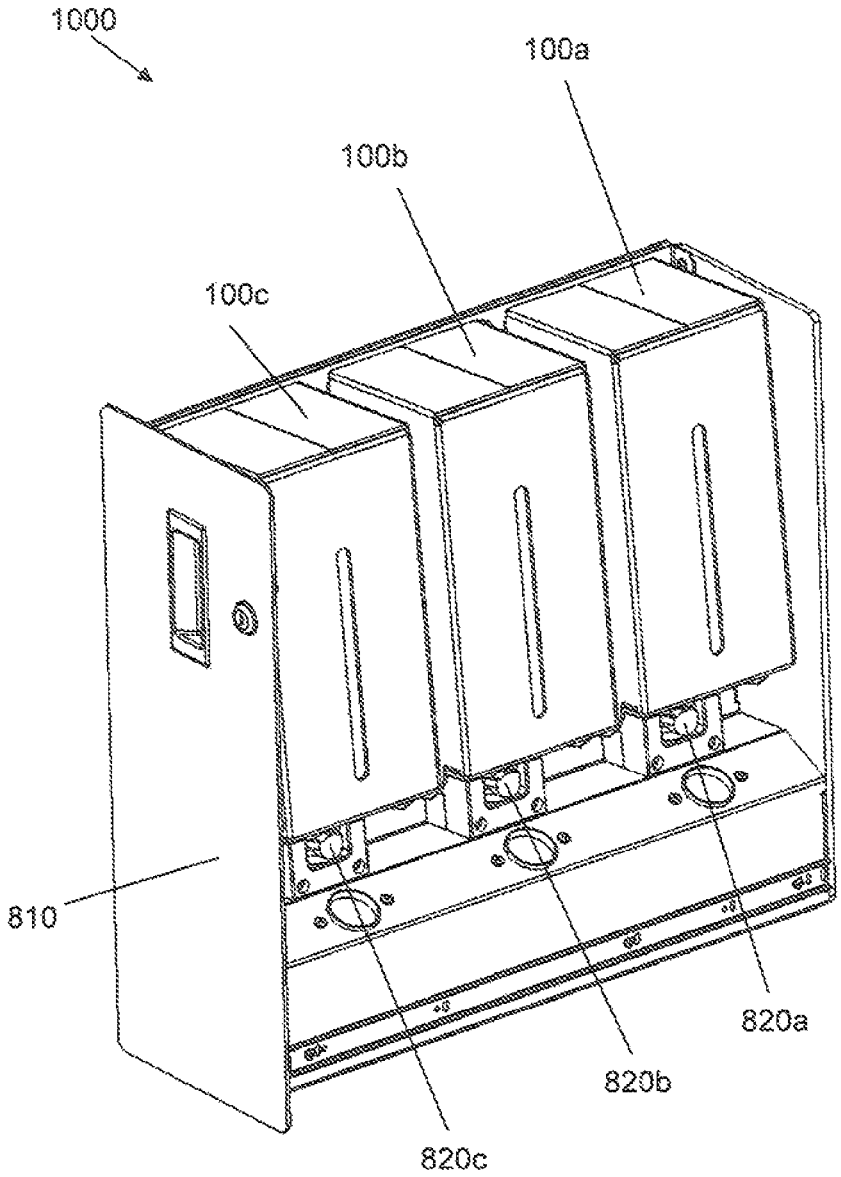
FIG. 10 illustrates a completely assembled example application for a bag-in-box container system.
Figure 11:
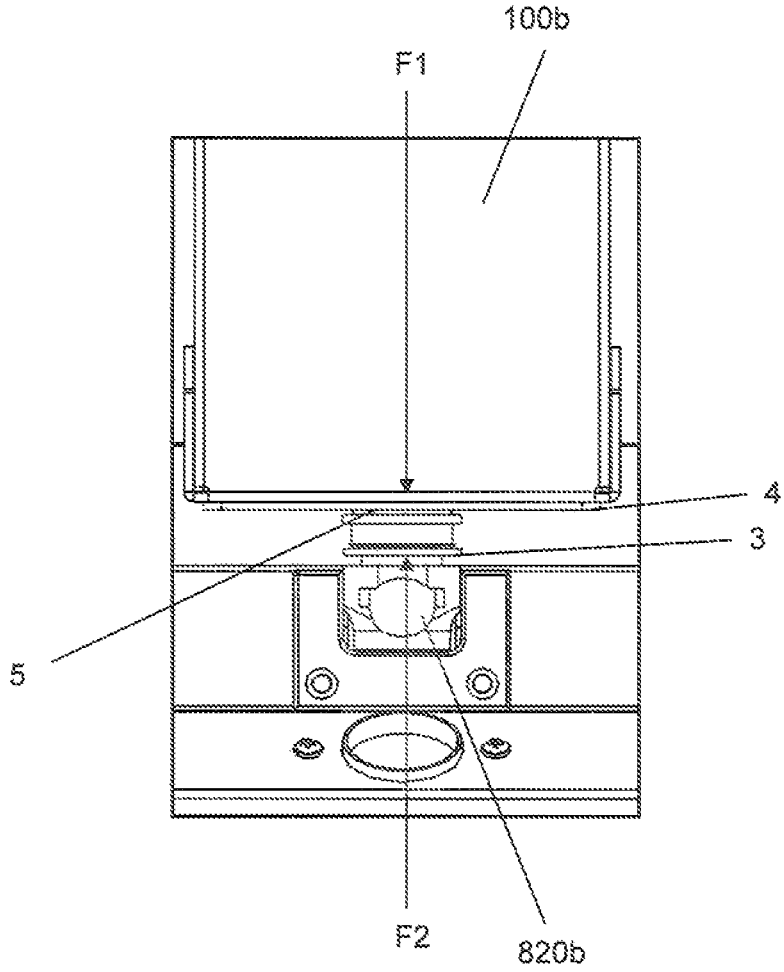
FIG. 11 illustrates an expanded or close up view of the completely assembled example application for a bag-in-box container system of FIG. 10.

FIG. 10 illustrates a completely assembled example application 1000 for bag-in-box container systems interacting with portions of dispensing machinery 810. FIG. 11 illustrates an expanded or close-up view of the completely assembled example application 1000 of FIG. 10. In example application 1000, multiple bag-in-box systems 100*a*, 100*b*, and 100*c* have been inserted into fixed holders 820*a*, 820*b*, and 820*c*, respectively, that may be part of dispensing machinery 810. Bag-in-box system 100*b*, for example, is inverted for connection to holder 820*b*. Once system 100*b* is inverted and connected to holder 820*b*, a force F2 representing the entire weight of system 100*b*, including the weight of the liquid inside system 100*b*, is exerted on the dispensing end pushing the dispensing end in the direction of the inside of system 100*b*. However, one of the walls that form the groove in the dispensing end transfers the weight to the clip engaging the dispensing end or other means of engagement, and effectively distributes at least some of the weight of system 100*b* along the opening surface of the box. The distribution of weight makes system 100*b* more rigid, stable, and reliable than a comparable system without the weight distribution attributes of the clip or other means of engagement. Moreover, in the example embodiment, system 100*b* is sufficiently strong to withstand force F2 even when force F2 includes force applied to the dispensing end in excess of the weight of system 100*b* to achieve the blind connection of system 100*b* to holder 820*b*.

After the contents of the bag have been exhausted, the bag-in-box system 100*b* may be removed from machinery 810, the clip (if one is used in the application) may be removed from the groove, the box opened, the bag removed from the box, and the bag or both the box and the bag may be collapsed to a relatively small volume to be discarded or recycled.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" is employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto."

While the present application illustrates various embodiments, and while these embodiments have been described in some detail, it is not the intention of the applicant to restrict or in any way limit the scope of the claimed invention to such detail. Departures may be made from such details without departing from the spirit or scope of the applicant's claimed invention. Therefore, the invention, in its broader aspects, is not limited to the specific details, the representative apparatus, and illustrative examples shown and described.

What is claimed is:

1. A method of providing skin treatment solution to a spraying machine, the method comprising:
- providing a bag having a dispensing end, the bag having skin treatment solution disposed therein;
- providing a box in a first orientation, wherein the box has a first wall with an opening disposed therein;
- providing a spraying machine having a holder configured to receive the dispensing end of the bag;
- inserting the bag in the box;
- closing the box with a portion of the dispensing end of the bag protruding through the opening in the first wall, wherein the first wall is a top surface of the box in the first orientation;
- securing the portion of the dispensing end outside of the box;
- inverting the box to a second orientation, such that the first wall is a bottom surface of the box in the second orientation;
- inserting the dispensing end of the bag into the holder of the spraying machine;
- distributing, at least partially, force exerted on the dispensing end, along the first wall; and
- the spraying machine interacting with the bag to apply the skin treatment solution to a human body.

2. The method of claim 1, where the securing comprises inserting a clip into a groove on the portion of the dispensing end of the bag protruding through the opening in the first wall.

3. The method of claim 2, wherein the inserting the clip includes inserting the clip into the groove such that the clip is in contact with at least half the surface area of an external surface of the first wall.

4. The method of claim 1, where the securing comprises inserting at least a portion of a flap that is part of the box into a groove on the portion of the dispensing end of the bag protruding through the opening in the box.

5. The method of claim 1, where securing comprises:
- inserting the portion of the dispensing end through a first diameter in the opening, where the first diameter is larger than a largest diameter in the portion of the dispensing end; and
- engaging the dispensing end and a second diameter in the opening.

6. The method of claim 4, where engaging includes pushing the dispensing end into the second diameter.

7. The method of claim 5, where engaging includes the dispensing end snapping into the second diameter.

8. A method of employing a bag-in-box container system in a spraying machine, the method comprising:
- providing a bag-in-box container system including:
  - a box including a first wall with an opening disposed therein, wherein the first wall is a top surface when the box is in a first orientation and the first wall is a bottom surface when the box is in a second orientation, and
  - a bag disposed inside the box, the bag having a dispensing end that protrudes through the opening in the first wall of the box;

providing a spraying machine having a holder configured to receive the dispensing end of the bag;

placing the bag-in-box container system in the second orientation;

inserting the dispensing end of the bag into the holder of the spraying machine;

distributing, at least partially, force exerted on the dispensing end, along the first wall; and the spraying machine interacting with the bag-in-box container system to apply skin treatment solution to a human body.

9. The method of claim 8, further comprising removing the bag-in-box container system from the spraying machine and disposing of the bag-in-box container system.

10. The method of claim 9, wherein the disposing of the bag-in-box container system includes removing the bag from the box, and collapsing the box.

11. The method of claim 8, wherein the dispensing end of the bag includes a collar and a groove, and wherein the bag-in-box container system further includes a clip that engages the dispensing end at the groove and is in contact with at least half the surface area of an external surface of the first wall.

12. The method of claim 11, wherein the clip is a load bearing structure that bears a first force pushing the dispensing end in a direction towards the inside of the box through the opening when the box is in the first orientation, and bears a second force pulling the dispensing end in a direction towards the outside of the box through the opening when the box is in the second orientation.

13. The method of claim 11, wherein the clip includes at least one engaging surface that engages the groove.

14. The method of claim 13, wherein the at least one engaging surface includes dimples that snap engage the groove.

15. A method of employing a bag-in-box container system in a spraying machine, the method comprising:

placing a box in a first orientation;

inserting a bag in the box;

closing the box with a portion of a dispensing end of the bag protruding through an opening in a first wall of the box, wherein the first wall is a top surface of the box in the first orientation;

securing the portion of the dispensing end outside of the box;

inverting the box to a second orientation, such that the first wall is a bottom surface of the box in the second orientation;

inserting the dispensing end of the bag into a holder of a spraying machine;

distributing, at least partially, force exerted on the dispensing end, along the first wall; and the spraying machine interacting with the bag to apply skin treatment solution to a human body.

16. The method of claim 15 further comprising:

placing a second box in a first orientation;

inserting a second bag in the second box;

closing the second box with a portion of a dispensing end of the second bag protruding through an opening in a second wall of the second box, wherein the second wall is a top surface of the second box in the first orientation;

securing the portion of the dispensing end of the second bag outside of the second box;

inverting the second box to a second orientation, such that the second wall is a bottom surface of the second box in the second orientation; and inserting the dispensing end of the second bag into a second holder of the spraying machine.

17. The method of claim 15, further comprising inserting a clip into a groove on the portion of the dispensing end of the bag protruding through the opening in the first wall, such that the clip is in contact with at least half the surface area of an external surface of the first wall.

18. The method of claim 17, wherein the inserting the clip into the groove on the portion of the dispensing end includes snapping the clip onto the portion of the dispensing end.

19. The method of claim 15, further comprising removing the dispensing end of the bag from the holder, removing the bag from the box, and collapsing the box.

20. The method of claim 15, wherein the first wall is a flat surface.

* * * * *